US010372077B2

(12) United States Patent
Iwasawa et al.

(10) Patent No.: US 10,372,077 B2
(45) Date of Patent: Aug. 6, 2019

(54) IMAGE FORMING APPARATUS

(71) Applicant: CANON KABUSHIKI KAISHA, Tokyo (JP)

(72) Inventors: Yusaku Iwasawa, Mishima (JP); Yasuharu Hirado, Mishima (JP); Tomoaki Nakai, Numazu (JP); Bunro Noguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/465,725

(22) Filed: Mar. 22, 2017

(65) Prior Publication Data

US 2017/0285554 A1 Oct. 5, 2017

(30) Foreign Application Priority Data

Mar. 31, 2016 (JP) ..... 2016-073054

(51) Int. Cl.
*G03G 21/00* (2006.01)

(52) U.S. Cl.
CPC ..... *G03G 21/0023* (2013.01)

(58) Field of Classification Search
None
See application file for complete search history.

(56) References Cited

U.S. PATENT DOCUMENTS 8,463,154 B2 6/2013 Akizuki et al.
2005/0100361 A1* 5/2005 Tanaka ..... G03G 15/751 399/101
2007/0065177 A1* 3/2007 Yamashita ..... G03G 21/105 399/127
2009/0232530 A1* 9/2009 Saito ..... G03G 15/161 399/50
2011/0026948 A1* 2/2011 Nagasu ..... G03G 15/553 399/35
2011/0188881 A1* 8/2011 Akizuki ..... G03G 15/16 399/99
2014/0169821 A1* 6/2014 Ichinose ..... G03G 15/556 399/71

FOREIGN PATENT DOCUMENTS

JP 2006-184689 A 7/2006
JP 2011-158676 A 8/2011
JP 2013-152312 A 8/2013

* cited by examiner

*Primary Examiner* — David M. Gray
*Assistant Examiner* — Geoffrey T Evans
(74) *Attorney, Agent, or Firm* — Venable LLP

(57) ABSTRACT

The image forming apparatus includes a control unit that executes a supply operation to supply a toner charged with a regular charge polarity, to at least one abutting portion of a plurality of abutting portions, at the time of image non-formation, the plurality of abutting portions being formed by a plurality of cleaning members and a plurality of image bearing members, the control unit determining an image bearing member to which the most amount of the toner charged with the regular charge polarity is supplied, based on image formation information, the image formation information being information about an image formation executed before the supply operation is executed.

9 Claims, 10 Drawing Sheets

FIG. 7

| | COMPARISON EMBODIMENT | EMBODIMENT 1 |
|---|---|---|
| COLLECTION STATION FOR POSITIVE POLARITY TONER | SECOND STATION | SECOND STATION |
| COLLECTION STATION FOR NEGATIVE POLARITY TONER | FIRST STATION | SECOND STATION |
| EVALUATION IMAGES | MAGENTA HALFTONE | MAGENTA HALFTONE |
| NO SHEET | PASS | PASS |
| 5000 SHEETS | PASS | PASS |
| 10000 SHEETS | PASS | PASS |
| 15000 SHEETS | FAIL | PASS |
| 20000 SHEETS | FAIL | PASS |
| 25000 SHEETS | FAIL | PASS |
| 30000 SHEETS | FAIL | FAIL |
| 35000 SHEETS | FAIL | FAIL |
| 40000 SHEETS | FAIL | FAIL |

FIG. 8

| | COMPARISON EMBODIMENT | EMBODIMENT 1 |
|---|---|---|
| COLLECTION STATION FOR POSITIVE POLARITY TONER | FIRST STATION | FIRST STATION |
| COLLECTION STATION FOR NEGATIVE POLARITY TONER | SECOND STATION | FIRST STATION |
| EVALUATION IMAGES | YELLOW HALFTONE | YELLOW HALFTONE |
| NO SHEET | PASS | PASS |
| 5000 SHEETS | PASS | PASS |
| 10000 SHEETS | PASS | PASS |
| 15000 SHEETS | PASS | PASS |
| 20000 SHEETS | PASS | PASS |
| 25000 SHEETS | FAIL | PASS |
| 30000 SHEETS | FAIL | PASS |
| 35000 SHEETS | FAIL | PASS |
| 40000 SHEETS | FAIL | PASS |
| 45000 SHEETS | FAIL | FAIL |
| 50000 SHEETS | FAIL | FAIL |

FIG. 9

| | COMPARISON EMBODIMENT (WITHOUT DISCHARGED PROCESS IN SHEET INTERVALS) | EMBODIMENT 2 (WITH DISCHARGED PROCESS IN SHEET INTERVALS) |
|---|---|---|
| EVALUATION IMAGES | YELLOW HALFTONE | |
| NO SHEET | PASS | PASS |
| 10000 SHEETS | PASS | PASS |
| 20000 SHEETS | PASS | PASS |
| 30000 SHEETS | PASS | PASS |
| 40000 SHEETS | FAIL | PASS |
| 50000 SHEETS | FAIL | PASS |
| 60000 SHEETS | FAIL | PASS |
| 70000 SHEETS | FAIL | PASS |
| 80000 SHEETS | FAIL | FAIL |

FIG. 10

| | COMPARISON EMBODIMENT (WITHOUT DISCHARGED PROCESS IN SHEET INTERVALS) | EMBODIMENT 3 (WITH DISCHARGED PROCESS IN SHEET INTERVALS) |
|---|---|---|
| EVALUATION IMAGES | YELLOW HALFTONE | |
| NO SHEET | PASS | PASS |
| 5000 SHEETS | PASS | PASS |
| 10000 SHEETS | PASS | PASS |
| 15000 SHEETS | PASS | PASS |
| 20000 SHEETS | PASS | PASS |
| 25000 SHEETS | PASS | PASS |
| 30000 SHEETS | PASS | PASS |
| 35000 SHEETS | PASS | PASS |
| 40000 SHEETS | PASS | PASS |
| 45000 SHEETS | FAIL | PASS |
| 50000 SHEETS | FAIL | PASS |
| 55000 SHEETS | FAIL | PASS |
| 60000 SHEETS | FAIL | FAIL |

IMAGE FORMING APPARATUS

BACKGROUND OF THE INVENTION

Field of the Invention

The present invention relates to an image forming apparatus using an electrophotographic technique or an electrostatic recording technique.

Description of the Related Art

Conventionally, in an intermediate-transfer image forming apparatus, as a method for removing a residual toner from an intermediate transferring member and collecting the residual toner, there is a method of charging the residual toner with the reverse polarity of a regular charge polarity, transferring the residual toner to a photosensitive member by a primary transfer unit and collecting the residual toner by a cleaning device for the photosensitive member.

Here, a cleaning blade (hereinafter, merely referred to as a "blade" also) is used as the cleaning device for the photosensitive member. The cleaning performance of the cleaning blade is greatly influenced by the condition of a blocking layer that is formed at a tip of the blade by an external additive of a toner (Japanese Patent Application Laid-Open No. 2006-184689). When the blocking layer is not sufficiently formed, the friction on the abutting portion between the blade and the photosensitive member produces a crack or flaw of the tip of the blade, or a tear or stick-slip (chatter) of the blade, and this sometimes causes the toner and the external additive to slip through the blade.

However, the construction of transferring the residual toner to the photosensitive member and removing the residual toner by the blade has the following problem. For example, when the regular charge polarity of the toner is the negative polarity, the residual toner charged with the positive polarity on the intermediate transferring member is transferred to the photosensitive member, at the same time that the toner with the negative polarity is primarily transferred to the intermediate transferring member, and then the residual toner is removed from the photosensitive member by the blade. On this occasion, in an image forming unit right after the charge with the positive polarity (on the most upstream side in the moving direction of the intermediate transferring member), a greater amount of the residual toner is transferred to the photosensitive member, compared to the other image forming units.

It has been found that the toner and the external additive of the toner easily slip through the blade in the image forming unit in which a large amount of the toner with the positive polarity is fed to the blade in this way. In some cases, the slipped toner and external additive adhere to a charging member that charges the photosensitive member, obstruct a uniform charge of the surface of the photosensitive member, and cause a density unevenness of the image.

SUMMARY OF THE INVENTION

An object of the present invention is to provide an image forming apparatus that can suppress the increase in the amount of the toner and external additive that slip through the cleaning member in a particular image forming unit.

An object of the present invention is to provide an image forming apparatus including: a plurality of image bearing members that bears toner images; a plurality of cleaning members that is arranged so as to abut on the plurality of image bearing members respectively and that removes a toner from the image bearing members; a movable intermediate transferring member that conveys the toner images primarily transferred from the plurality of image bearing members for secondarily transferring the toner images to a recording material; a charging member that charges a residual toner with a reverse polarity of a regular charge polarity, the residual toner being a toner remaining on the intermediate transferring member after the secondary transfer; and a control unit that executes a supply operation to supply a toner charged with the regular charge polarity, to at least one abutting portion of a plurality of abutting portions, at the time of image non-formation, the plurality of abutting portions being formed by the plurality of cleaning members and the plurality of image bearing members, the control unit determining an image bearing member to which the greatest amount of the toner charged with the regular charge polarity is supplied, based on image formation information, the image formation information being information about an image formation executed before the supply operation is executed.

Further features of the present invention will become apparent from the following description of exemplary embodiments with reference to the attached drawings.

BRIEF DESCRIPTION OF THE DRAWINGS

FIG. 7 is a table illustrating an effect of the embodiment.

FIG. 8 is a table illustrating an effect of the embodiment.

FIG. 9 is a table illustrating an effect of the embodiment.

FIG. 10 is a table illustrating an effect of the embodiment.

DESCRIPTION OF THE EMBODIMENTS

Preferred embodiments of the present invention will now be described in detail in accordance with the accompanying drawings.

Hereinafter, an image forming apparatus according to the present invention will be described in detail with reference to the drawings.

[Embodiment 1]

1. Overall Construction and Operation of Image Forming Apparatus

Figure 1:
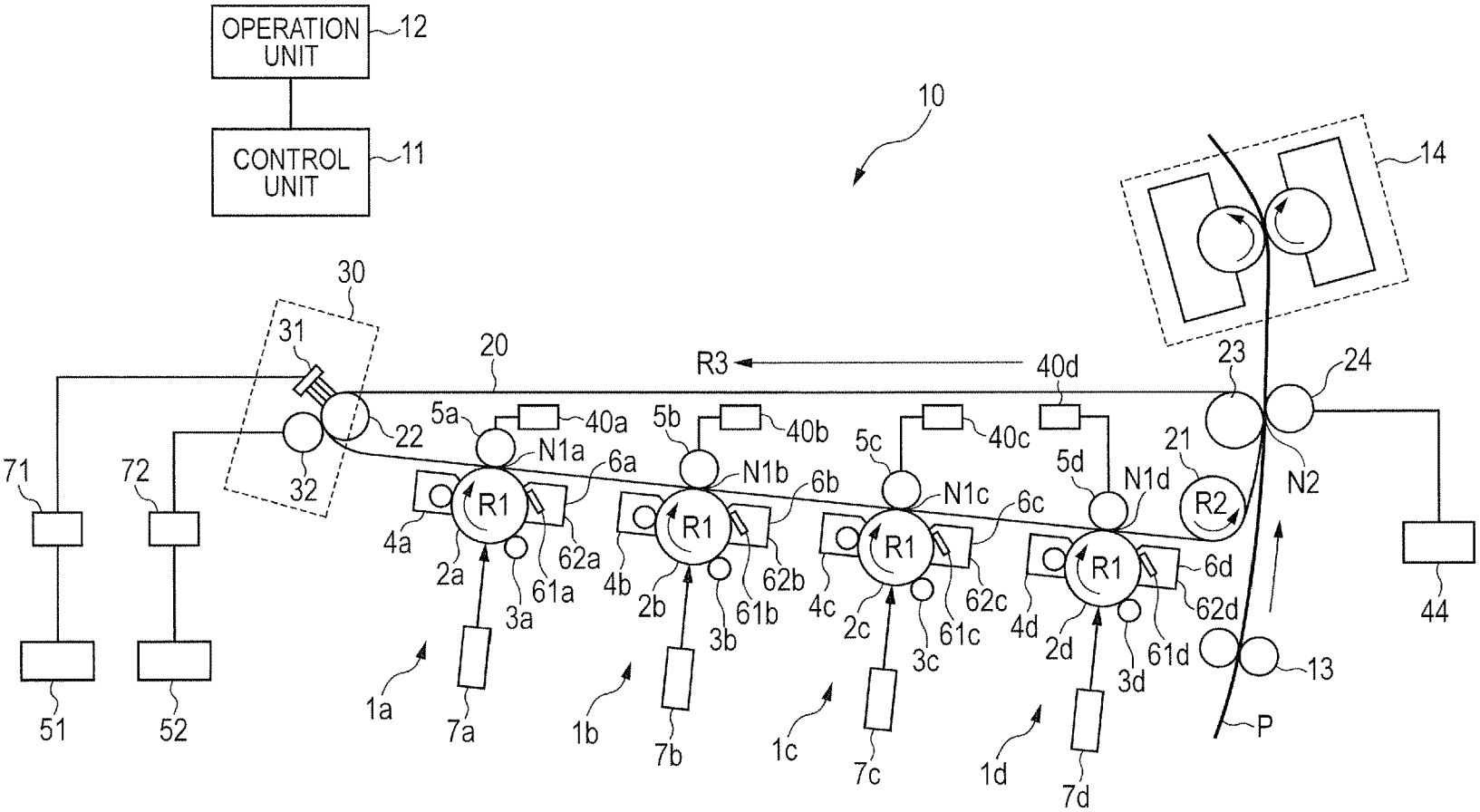
FIG. 1 is a schematic cross-sectional view of an image forming apparatus.

As illustrated in FIG. 1, an image forming apparatus 10 in the embodiment includes first, second, third and fourth stations 1*a*, 1*b*, 1*c*, 1*d* that form yellow, magenta, cyan and black images respectively. In the first to fourth stations 1*a* to 1*d*, elements having identical or corresponding functions and constructions are sometimes described inclusively, while the tail ends a, b, c, d of the reference characters are omitted. Each of the tail ends a, b, c, d indicates a color to be treated by the element.

A drum-type photosensitive member (electrophotographic photosensitive member) 2 as an image bearing member is driven to rotate at a predetermined circumferential speed in the direction of an arrow R1 in the figure. The surface of the rotating photosensitive member is evenly charged with a predetermined polarity (the negative polarity in the embodiment) at a predetermined electric potential, by a drum charge roller 3 that is a roller-type charging member as a photosensitive member charge device. The charged surface of the photosensitive member 2 is scanned and exposed according to image information, by an exposing apparatus (laser scanner) 7 as an exposing device, so that an electrostatic latent image (electro latent image) is formed on the photosensitive member 2. The electrostatic latent image formed on the photosensitive member 2 is developed using a toner by a developing apparatus 4 as a developing device, so that a toner image is formed on the photosensitive member 2. In the embodiment, the absolute value of the electric potential of the photosensitive member 2 is decreased by the exposure after the even charge, and the toner charged with the same polarity (the negative polarity in the embodiment) as the charge polarity of the photosensitive member 2 adheres to an exposure device on the photosensitive member 2 (reversal development technique). In the embodiment, the regular charge polarity, which is the charge polarity of the toner at the time of the development, is the negative polarity, and the toner for forming the toner image mainly has the negative charge.

An intermediate transfer belt 20 constructed by an endless belt is arranged so as to face the photosensitive members 2. The intermediate transfer belt 20 is an example of the movable intermediate transferring member that conveys the toner images primarily transferred from the plurality of photosensitive members 2 for secondarily transferring the toner images to a recording material P. The intermediate transfer belt 20 is wound around a plurality of stretching rollers, that is, a drive roller 21, a tension roller 22 and a secondary transfer facing roller 23, and is stretched at a predetermined tension. The drive roller 23 is driven to rotate in the direction of an arrow R2 in the figure, and thereby, the intermediate transfer belt 20 rotates (revolves) in the direction of an arrow R3 in the figure, at a circumferential speed (process speed) equivalent to the circumferential speed of the photosensitive member 2. On the inner circumferential surface side of the intermediate transfer belt 20, primary transfer rollers 5*a* to 5*d* that are roller-type primary transfer members as primary transfer devices are arranged corresponding to the photosensitive members 2. The primary transfer roller 5 is pressed toward the photosensitive member 2 through the intermediate transfer belt 20, so as to form a primary transfer portion N1 where the photosensitive member 2 contacts with the intermediate transfer belt 20.

At the primary transfer portion N1, the toner image formed on the photosensitive member 2 is primarily transferred onto the rotating intermediate transfer belt 20, by the action of the primary transfer roller 5. In the primary transfer process, a primary transfer bias (primary transfer voltage) with the reverse polarity (the positive polarity in the embodiment) of the regular charge polarity of the toner is applied from a primary transfer power source 40 to the primary transfer roller 5. For example, in the formation of a full-color image, the yellow, magenta, cyan and black toner images formed on the photosensitive members are sequentially transferred onto the intermediate transfer belt 20 so as to be superimposed.

On the outer circumferential surface side of the intermediate transfer belt 20, a secondary transfer roller that is a roller-type secondary transfer member as a secondary transfer device is arranged at a position facing the secondary transfer facing roller 23. The secondary transfer roller 24 is pressed toward the secondary transfer facing roller 23 through the intermediate transfer belt 20, so as to form a secondary transfer portion N2 where the secondary transfer roller 24 contacts with the intermediate transfer belt 20.

At the secondary transfer portion N2, the toner image formed on the intermediate transfer belt 20, by the action of the secondary transfer roller 24, is secondarily transferred to the recording material P such as a paper sheet that is conveyed while being sandwiched between the intermediate transfer belt 20 and the secondary transfer roller. In the secondary transfer process, a secondary transfer bias (secondary transfer voltage) with the reverse polarity (the positive polarity in the embodiment) of the regular charge polarity of the toner is applied from a secondary transfer power source 44 to the secondary transfer roller 24. The recording material P is conveyed to a resist roller 13 by an unillustrated feeding apparatus, and is supplied to the secondary transfer portion N2 at a timing synchronized with the toner image on the intermediate transfer belt 20 by the resist roller 13.

The recording material P having the toner image transferred is heated and compressed by a fixing apparatus 14 as a fixing device, and is ejected to the exterior of the image forming apparatus 10 after the fixation (melting fixation) of the toner image.

The toner remaining on the photosensitive member 2 after the primary transfer process is removed from the photosensitive member 2 and is collected, by a drum cleaning apparatus 6 as a photosensitive member cleaning device. The drum cleaning apparatus 6 includes a blade 61 as a cleaning member that is arranged so as to abut on the photosensitive member 2. By the blade 61, the primary transfer residual toner is scraped from the surface of the rotating photosensitive member 2, and is collected in a collected toner container 62. The blade 61 is a plate-shaped (blade-shaped) member that is formed of an elastic material (urethane rubber or the like). The blade 61 abuts in the counter direction relative to the rotation direction of the photosensitive member 2 (in the direction in which the free edge is oriented to the upstream side in the rotation direction of the photosensitive member 2). A belt cleaning mechanism 30 as an intermediate transferring member cleaning device will be described later in detail.

In the embodiment, the photosensitive member 2 is an OPC (organic photo conductor) that is charged with the negative polarity, and includes a photosensitive layer on an aluminum base drum. In the embodiment, the drum charge roller 3 contacts with the photosensitive member 2 at a predetermined contact pressure. In the embodiment, the drum charge roller 3 is a roller in which a nickel-plated copper rod having a diameter of 8 mm is coated with an elastic layer having a thickness of 4 mm. The elastic layer is made of an ethylene propylene diene rubber (EPDM) in which carbon is dispersed. In the embodiment, the intermediate transfer belt 20 is formed of PEN (polyethylene naphthalate) resin. In the embodiment, the surface resistivity of the intermediate transfer belt 20 is $5.0\times10^{11}$ Ω/□, and the volume resistivity is $8.0\times10^{11}$ Ωcm. In the embodiment, the primary and secondary transfer power sources 40, 44 can selectively apply biases with the positive polarity and negative polarity.

A control unit (CPU) 11, which is provided in an apparatus body of the image forming apparatus 10, integrally controls the operations of each unit of the image forming apparatus 10, according to a program stored in a storage unit (memory). Here, the image forming apparatus 10 executes a job (print operation) that is a sequence of operations to form images and output the images on a single or a plurality of recording materials P. The job is started by a start instruction. The job, generally, includes an image formation process, a pre-rotation process, a sheet interval process and a post rotation process. The image formation process is a process in a time period during which the formation of the electrostatic latent image and toner image and the transfer are actually performed, and the time of image formation means this time period. The pre-rotation process is a process in a time period during a preparation operation is performed from the start instruction to the start of image formation, and the post rotation process is a process in a time period during which a preparation operation is performed after the image formation process. The sheet interval process (image interval process) is a process in a time period corresponding to the interval between a recording material P and a recording material P when images are formed on a plurality of recording materials P. The time of image non-formation is a time period other than the time of image formation, and includes the above pre-rotation process, sheet interval process and post rotation process.

2. Belt Cleaning Mechanism

Figure 2:
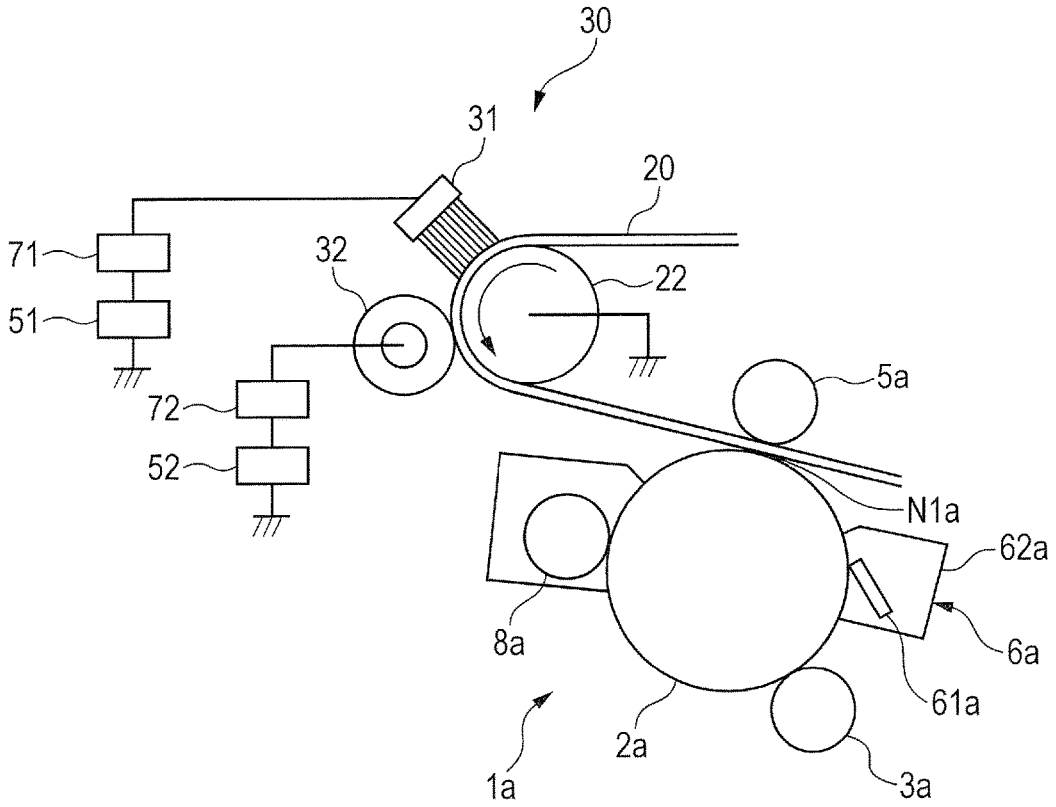
FIG. 2 is a schematic cross-sectional view of the vicinity of a belt cleaning mechanism.

FIG. 2 is a schematic cross-sectional view of the vicinity of the belt cleaning mechanism 30 in the embodiment. In the embodiment, the belt cleaning mechanism 30 includes a conductive brush 31 that is a first charging member, and a charge roller 32 that is a second charging member, as charge devices that charge the residual toner. The conductive brush 31 and the charge roller 32 are arranged so as to contact with the intermediate transfer belt 20, downstream of the secondary transfer unit N2 and upstream of the primary transfer unit N1 (the most upstream primary transfer unit N1*a*) in the moving direction of the intermediate transfer belt 20. In the embodiment, the conductive brush 31 and the charge roller 32 are pressed toward the tension roller 22 through the intermediate transfer belt 20. The charge roller 32 is arranged downstream of the conductive brush 31 in the moving direction of the intermediate transfer belt 20.

In the embodiment, the conductive brush 31 is a brush formed of conductive nylon. The fineness is 7 decitex, the pile length is 5 mm and the brush width (in the moving direction of the intermediate transfer belt 20) is 5 mm. The electric resistance of the conductive brush 31 is $1.0\times10^6$ Ω when 500 V is applied in a state where the conductive brush 31 is pressed on an aluminum cylinder at a force of 9.8 N and is rotated at 50 mm/sec. Instead of the conductive brush 31, a foamed sponge member (formed of urethane rubber or NBR hydrin rubber, for example) to be fixedly arranged, a rotatable fur brush roller, a rotatable foamed sponge roller or the like may be used.

In the embodiment, the charge roller 32 is a roller in which a nickel-plated copper rod having a diameter of 6 mm is coated with a solid elastic member having a thickness of 5 mm. The solid elastic member is made of an EPDM rubber in which carbon is dispersed. The electric resistance of the charge roller 32 is $5.0\times10^7$ Ω when 500 V is applied in a state where the charge roller 32 is pressed on an aluminum cylinder at a force of 9.8 N and is rotated at 50 mm/sec. The charge roller 32 is pressed at a total pressure of 9.8 N toward the tension roller 22 through the intermediate transfer belt 20.

The conductive brush 31 and the charge roller 32 are electrically connected with first and second cleaning power sources (high-voltage power source circuits) 51, 52 through first and second ammeters (current measuring circuits) 71, 72 as current detecting devices, respectively. The first and second cleaning power sources 51, 52 can selectively apply biases with the positive polarity and negative polarity, to the conductive brush 31 and the charge roller 32, respectively. The tension roller 22 is electrically earthed (connected to the ground).

At the time of cleaning operation, direct-current voltages with the positive polarity (herein, referred to as "positive biases" also) are applied from the first and second cleaning power sources 51, 52 to the conductive brush 31 and the charge roller 32, respectively. The output values of the direct-current voltages of the first and second cleaning power sources 51, 52 are controlled based on the currents detected by the first and second ammeters 71, 72, respectively, and a constant current control is performed such that the current values become target current values that are previously set. As the target current values, values at which the residual toner is not excessively charged and a cleaning defect does not occur due to an insufficient charge are selected. In the embodiment, the target current value of the conductive brush 31 in the cleaning operation is 20 μA, and the target current value of the charge roller 32 is 30 μA.

Figure 3A:
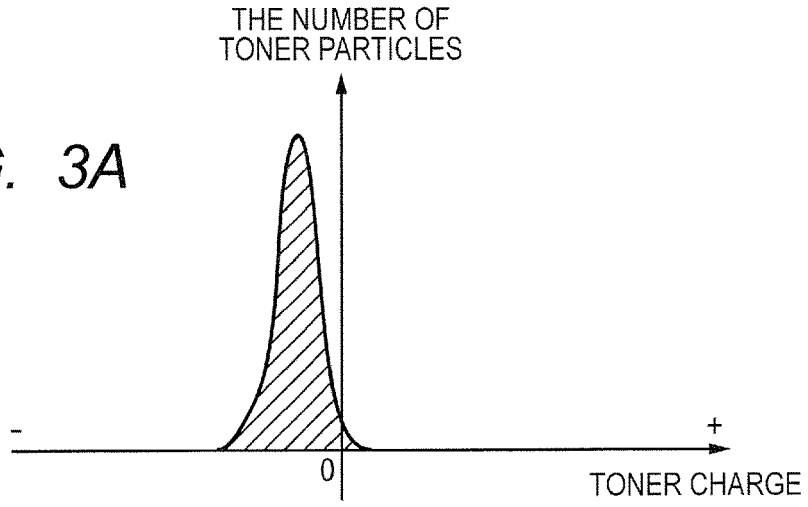
FIG. 3A, FIG. 3B and FIG. 3C are graphs for describing the charge distribution of a toner.
Figure 3B:
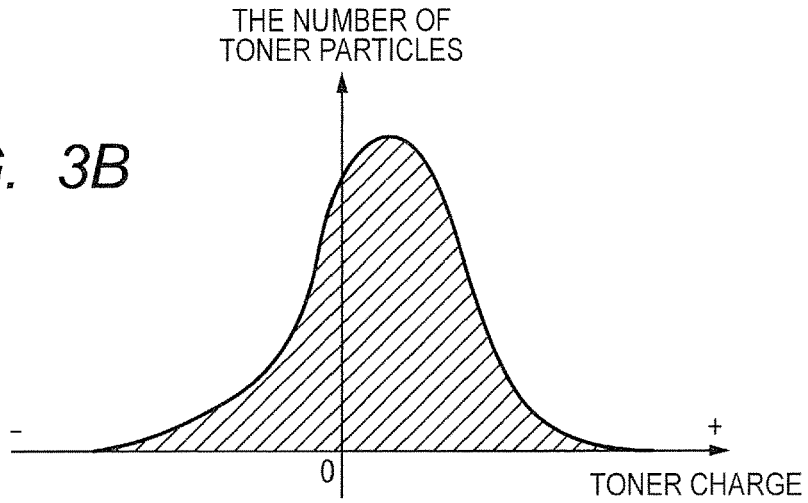
Figure 3C:
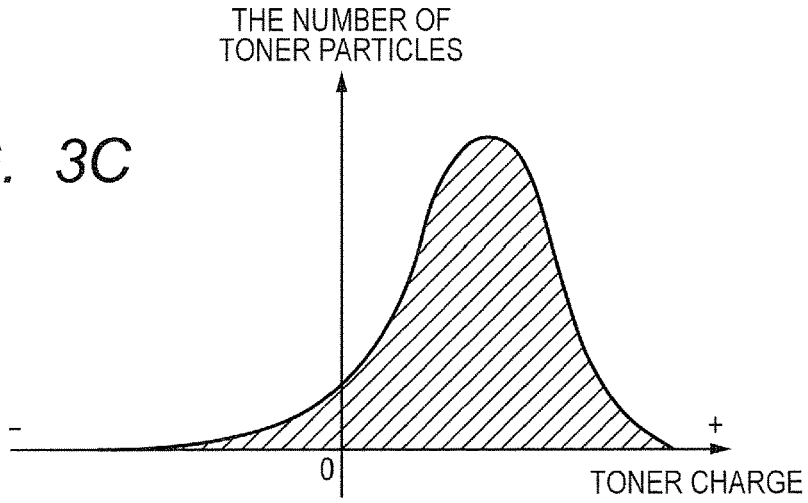

Here, FIG. 3A to FIG. 3C are graphs schematically illustrating the charge distribution of the toner. FIG. 3A illustrates an example of the charge distribution of the toner on the intermediate transfer belt 20 before the secondary transfer process, and FIG. 3B illustrates an example of the charge distribution of the residual toner on the intermediate transfer belt after the secondary transfer process. The residual toner is in a state where toners charged with the negative polarity, toners hardly charged and toners charged with the positive polarity are mixed by the influence of the secondary transfer bias.

At the time of the cleaning operation, since the positive bias is applied to the conductive brush 31, a positive electric field is formed from the conductive brush toward the intermediate transfer belt 20, and the negatively-charged toners of the residual toners are electrostatically collected by the conductive brush 31. Thereby, it is possible to decrease the amount of toners that pass through the charge roller 32 at the time of the cleaning operation. In addition, the conductive brush 31 also has an action of dispersing toners to pass while charging (pre-charging) the residual toner with the positive polarity by the electric discharge for the residual toner.

Further, at the time of the cleaning operation, since the positive bias is applied to the charge roller 32, the residual toner having passed through the conductive brush is evenly charged with the positive polarity by the electric discharge caused by the electric potential difference between the charge roller 32 and the intermediate transfer belt 20. The residual toner charged with the positive polarity is moved to the primary transfer unit N1*a* of the first station 1*a*, by the charge roller 32. Then, in the first station 1*a*, the residual toner is transferred from the intermediate transfer belt 20 to the photosensitive member 2*a* simultaneously with the primary transfer, by the action of the primary transfer bias with the positive polarity that is applied to the primary transfer roller 5*a*. Thereafter, by the blade 61*a* of the drum cleaning apparatus 6*a*, the residual toner is removed from the photosensitive member 2*a* and is collected in the collected toner container 62*a*.

3. Discharged Process

When the positive biases are applied to the conductive brush 31 and the charge roller 32 during the cleaning operation, the toner charged with the negative polarity accumulates on the conductive brush 31 and the charge roller 32. Then, when the accumulation amount reaches a predetermined amount, the toner cannot be collected and held any more, resulting in the decrease in the cleaning performance. Hence, a discharged process is performed. In the discharged process, the toner held on the conductive brush 31 and the charge roller 32 is periodically discharged (moved) to the intermediate transfer belt 20.

The discharged process is performed at a timing when the image is not being formed (at the time of the image non-formation), for example, at the time of post rotation (the post rotation process of each job, in the embodiment) or at the time of a handling operation after the occurrence of a jam (the feed path is clogged with the recording material P). In the discharged process, direct-current voltages with the negative polarity (herein, referred to as "negative biases" also) are applied from the first and second cleaning power sources 51, 52 to the conductive brush 31 and the charge roller 32, respectively. Thereby, a negative electric field is formed from the conductive brush 31 and the charge roller 32 toward the intermediate transfer belt. Most of the toners accumulated on the conductive brush 31 and the charge roller 32 are toners with the negative polarity, and therefore, are discharged onto the intermediate transfer belt 20 by electrostatic attractive force. In the embodiment, in the discharged process, negative biases of −1000 V and −1500 V are applied from the first and second cleaning power sources 51, 52 to the conductive brush 31 and the charge roller 32 under constant voltage control, respectively.

Further, toners charged with the positive polarity by the electric discharge slightly accumulate on the conductive brush 31 and the charge roller 32. Hence, in the discharged process, positive biases are also applied to the conductive brush 31 and the charge roller 32, for discharging the toners charged with the positive polarity. In the embodiment, in the discharged process, positive biases of +1000 V and +1500 V are applied from the first and second cleaning power sources 51, 52 to the conductive brush 31 and the charge roller 32 under constant voltage control, respectively. Particularly, in the embodiment, in the discharged process, the above negative biases and positive biases are applied repeatedly while being switched alternately.

The toner (herein, referred to as the "discharged toner" also) discharged onto the intermediate transfer belt in the discharged process is transferred from the intermediate transfer belt 20 to the photosensitive member 2, and is collected by the drum cleaning apparatus 6 (collection process). In the embodiment, also at the time of the collection process, the photosensitive member 2 is evenly charged at the same charge potential as that at the time of the image formation.

4. Supply Operation (Discharged Process, Discharged Toner Collection Process)

Figure 4A:
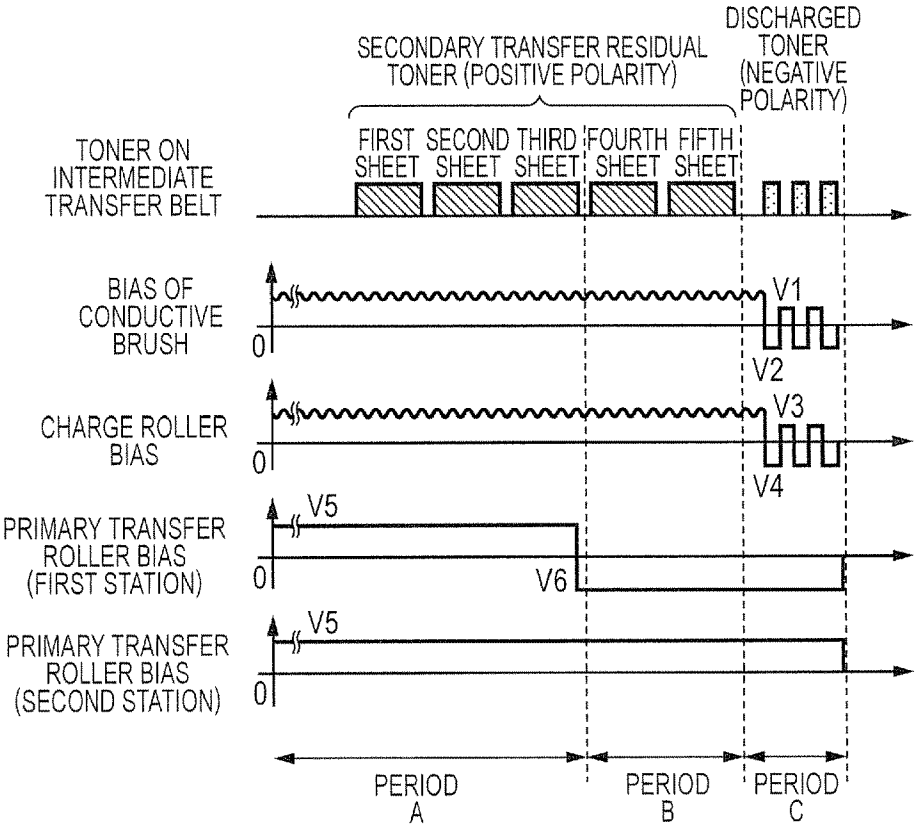
FIG. 4A and FIG. 4B are timing charts for controls in an embodiment.
Figure 4B:
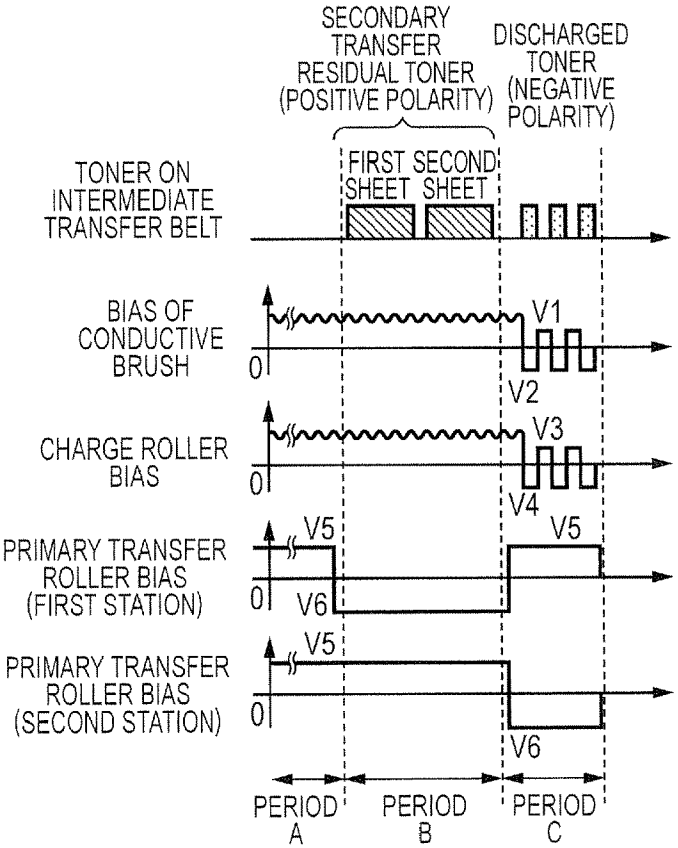

FIG. 4A and FIG. 4B are timing charts illustrating biases that are applied in the job to the conductive brush 31, the charge roller 32, the primary transfer roller 5*a* of the first station 1*a* and the primary transfer roller 5*b* of the second station 1*b*. FIG. 4A illustrates a case of continuously printing five sheets, and FIG. 4B illustrates a case of continuously printing two sheets.

Here, FIG. 4A and FIG. 4B, in each of which the abscissa indicates time, are configured as follows, for facilitating the understanding of the toner collection process. Namely, with respect to the timing of the bias that is applied to the conductive brush 31, the timings of the biases that are applied to the members are shifted by (the movement distances on the intermediate transfer belt 20 from the conductive brush 31 to the members)/(the process speed). That is, in FIG. 4A and FIG. 4B, the abscissa corresponds to the position in the circumferential direction of the intermediate transfer belt 20, and the biases that are applied to the members when a certain position on the intermediate transfer belt 20 passes through contact portions with the members are indicated so as to be arrayed and compared in tandem.

A control in the case of continuously printing five sheets as illustrated in FIG. 4A will be described. First, in a period A, the cleaning operation (the charge of the toner and the collection of the charged toner that is simultaneous with the primary transfer) of the residual toners of the first to third images is performed. That is, when the residual toners of the first to third images pass through the conductive brush 31, the positive bias (target current value of 20 μA) is applied to the conductive brush 31 under constant current control. When the residual toners of the first to third images pass through the charge roller 32, the positive bias (target current value of 30 μA) is applied to the charge roller 32 under constant current control. The residual toners of the first to third images are charged with the positive polarity by passing through the charge roller 32, and when the residual toners pass through the primary transfer unit N1*a* of the first station 1*a*, a positive bias V5 is applied to the primary transfer roller 5*a* of the first station 1*a* under constant voltage control. As the positive bias V5, a bias that maximizes the primary transfer efficiency is selected, and in the embodiment, the positive bias V5 is +600 V under 23° C./50% RH environment. The positive bias V5, because of varying depending on conditions such as the environment, is optimized for each condition.

Next, in a period B, the cleaning operation (the charge of the toner and the collection of the charged toner that is simultaneous with the primary transfer) of the residual toners of the fourth and fifth images is performed. That is, similarly to the period A, when the residual toners of the fourth and fifth images pass through each of the conductive brush 31 and the charge roller 32, the positive bias is applied to each of the conductive brush 31 and the charge roller 32 under constant current control. The residual toners of the fourth and fifth images are charged with the positive polarity by passing through the charge roller 32. When the residual toners pass through the primary transfer unit N1*a* of the first station 1*a*, the primary transfer has been already completed in the first station 1*a*. Therefore, at this time, it is not necessary to apply the positive bias to the primary transfer roller 5*a* of the first station 1*a*. Hence, in the embodiment, at this time, a negative bias V6 is applied to the primary transfer roller 5*a* of the first station 1*a* under constant voltage control.

Here, the reason why the negative bias is applied to the primary transfer roller 5*a* of the first station 1*a* in the period B is to suppress the collected amount of the toner with the positive polarity in the first station 1*a* by avoiding the collection of the residual toners of the fourth and fifth images in the first station 1*a*. That is, in the period A, since the primary transfer has not been completed in the first station 1*a*, it is necessary to apply the positive bias to the primary transfer roller 5*a* of the first station 1*a*. Therefore, the collected amount of the toner with the positive polarity in the first station 1*a* is larger compared to those in the other stations 1*b* to 1*d*. On the other hand, in the embodiment, when the residual toners of the image for the next-to-last sheet in the job (the fourth image) and the image for the last sheet (the fifth image) return to the primary transfer unit N1*a* of the first station 1*a*, the primary transfer process has been already completed in the first station 1*a*. Hence, in the period B, the negative bias V6 is applied to the primary transfer roller 5*a* of the first station 1*a*. Thereby, the toner with the positive polarity is prevented from being collected in the first station 1*a*, and the collected amount of the toner with the positive polarity in the first station 1*a* is suppressed. As the negative bias V6, a voltage at which the toner charged with the positive polarity is not collected in the first station 1*a* is selected, and in the embodiment, the negative bias V6 is −1000 V.

When the residual toners with the positive polarity not collected in the first station 1*a* pass through the primary transfer unit N1*b* of the second station 1*b*, the positive bias V5 is applied to the primary transfer roller 5*b* of the second station 1*b*, so that the residual toners are collected in the second station 1*b*.

Next, in a period C, the discharged process and the discharged toner collection process are performed. That is, after the residual toners of all images in the job pass through the conductive brush 31 and the charge roller 32, a negative bias V2 and a positive bias V1 are alternately applied to the conductive brush 31, and a negative bias V4 and a positive bias V3 are alternately applied to the charge roller 32. In the embodiment, V1=+1000 V, V2=−1000 V, V3=+1500 V and V4=−1500 V hold. Most of the discharged toners are toners with the negative polarity. When the discharged toners pass through the primary transfer unit N1*a* of the first station 1*a*, the negative bias V6 is applied to the primary transfer roller 5*a* of the first station 1*a*, so that the discharged toners are collected in the first station 1*a*. Discharged toners with the positive polarity present in minute amounts are collected in the second station 1*b*, when the positive bias V5 is applied to the primary transfer roller 5*b* of the second station 1*b*.

Here, the reason why the discharged toner is purposely collected in the first station 1*a* is to feed the toner with the negative polarity to the blade 61*a* of the first station 1*a* in which the collected amount of the toner with the positive polarity is large. The reason will be described later in detail. Thus, in the embodiment, the discharged process and the discharged toner collection process configure a supply operation to supply the toner charged with the regular charge polarity to the abutting portion between the photosensitive member 2*a* and the blade 61*a*.

A control in the case of continuously printing two sheets as illustrated in FIG. 4B will be described. In periods A, B in FIG. 4B, the same control as that in the periods A, B in FIG. 4A is performed. That is, when the residual toners of the first and second images pass through the conductive brush 31 and the charge roller 32, the positive biases are applied to the conductive brush 31 and the charge roller 32 under constant current control. The residual toners of the first and second images are charged with the positive polarity by passing through the charge roller 32. When the residual toners pass through the primary transfer unit N1*a* of the first station 1*a*, the primary transfer has been already completed in the first station 1*a*. Therefore, similarly to the period B in FIG. 4A, the negative bias V6 is applied to the primary transfer roller 5*a* of the first station 1*a*. Then, the residual toners not collected in the first station 1*a* are fed to the primary transfer unit N1*b* of the second station 1*b*, and are collected in the second station 1*b* by the positive bias V5 being applied to the primary transfer roller 5*b* of the second station 1*b*.

Meanwhile, in a period C in the FIG. 4B, unlike the period C in FIG. 4A, the positive bias V5 is applied to the primary transfer roller 5*a* of the first station 1*a*, and the negative bias V6 is applied to the primary transfer roller 5*b* of the second station 1*b*. Therefore, discharged toners with the negative polarity are not collected in the first station 1*a*, and are collected in the second station 1*b*. Discharged toners with the positive polarity present in minute amounts are collected in the first station 1*a* when the positive bias V5 is applied to the primary transfer roller 5*a* of the first station 1*a*.

Thus, in the case of continuously printing two sheets, since the station 1 in which the collected amount of the toner with the positive polarity is large is the second station 1*b*, the discharged toner with the negative polarity is collected not in the first station 1*a* but in the second station 1*b*.

As described above, in the embodiment, the discharged toner (the toner with the negative polarity) is collected in the station 1 in which the greatest amount of the residual toner (the toner with the positive polarity) is collected during the job. Specifically, the station 1 to collect the discharged toner is changed depending on the number of continuous prints in the job. When the number of continuous prints is less than four (less than a predetermined value), the discharged toner with the negative polarity is collected in the second station 1*b* as illustrated in FIG. 4B. On the other hand, when the number of continuous prints is more than or equal to four (more than or equal to the predetermined value), the discharged toner with the negative polarity is collected in the first station la as illustrated in FIG. 4A. That is, in the embodiment, the control unit 11 determines the photosensitive member 2 to which the discharged toner with the negative polarity is supplied, based on the information about the image formation executed before the supply operation is executed, and on the number of prints in one job.

Incidentally, in some cases, the toner can be sufficiently discharged, merely by applying, to the charging member, a bias with the same polarity as the regular charge polarity of the toner, or merely by bias stop (or earth state).

5. Reason why Negative Polarity Toner is Fed to Station in which Collected Amount of Positive Polarity Toner is Large The reason why the toner with the negative polarity is fed to the station 1 in which the collected amount of the toner with the positive polarity is large is to stably maintain the sliding property between the photosensitive member 2 of the station 1 and the blade 61. That is, the sliding property between the photosensitive member 2 and the blade 61 is greatly influenced by the condition of a blocking layer that is formed at a tip of the blade 61. The "blocking layer" is a layer that is formed at a region (wedged region) close to the upstream side of the abutting portion between the photosensitive member 2 and the blade 61. The upstream side is the upstream side in the moving direction of the photosensitive member 2. The main component of the blocking layer is an external additive (generally, a fine particle such as silica or titanium oxide that has a smaller diameter than the toner as the base material) contained in the toner.

Figure 5A:
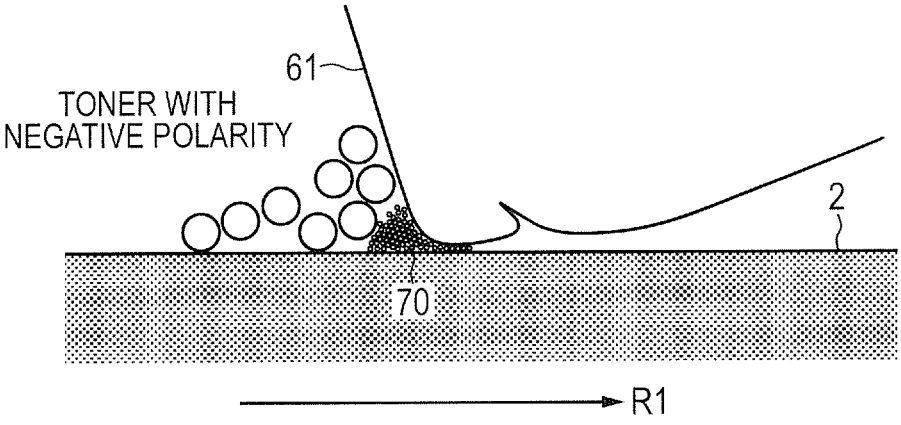
FIG. 5A and FIG. 5B are schematic views of a blocking layer.
Figure 5B:
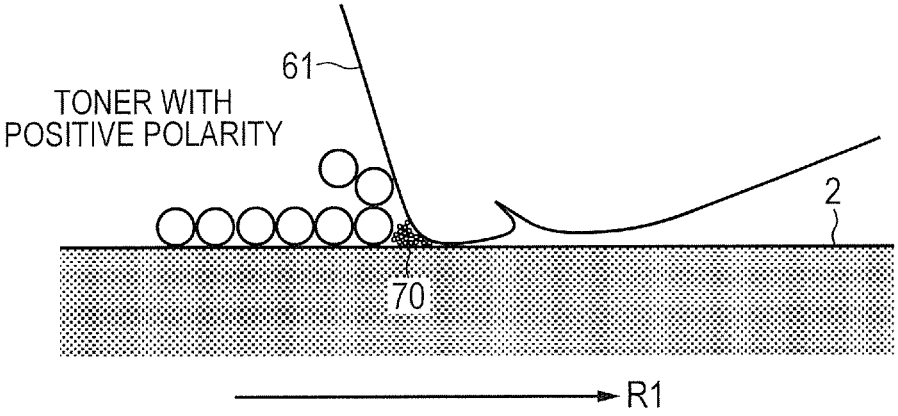

FIG. 5A and FIG. 5B are schematic views of a blocking layer 70. When the toner is scraped from the photosensitive member 2 by the blade 61 or when the toner is retained at the vicinity of the blade 61, the external additive contained in the toner is isolated, so that the blocking layer 70 is formed at the tip of the blade 61 as a wedged layer. By the formation of the blocking layer 70, some of the external additives forming the blocking layer 70 enter the interval between the blade 61 and the photosensitive member 2, and the friction on the abutting portion between the blade 61 and the photosensitive member 2 is suppressed. Thereby, a crack or flaw of the tip of the blade 61, or a tear or stick-slip (chatter) of the blade is suppressed. When the blocking layer 70 is not sufficiently formed, the friction between the blade 61 and the photosensitive member 2 sometimes produces a crack or flaw of the tip of the blade 61, or a tear or chatter of the blade. This sometimes causes the toner and the external additive to slip through the blade 61, resulting in the decrease in the cleaning performance. Then, for example, when the number of prints is increased, the surface of the drum charge roller 3 is dirtied by the toner and the external additive. When the surface of the drum charge roller 3 is dirtied by the toner and the external additive, the surface of the photosensitive member 2 cannot be sometimes evenly charged, causing an image defect such as a density unevenness.

Therefore, it is desirable to stably form the blocking layer 70. As the result of many experimental studies, the inventors have found that the charge polarity of the toner to be collected from the photosensitive member 2 by the blade 61 generates a difference in the condition of the blocking layer 70 to be formed at the tip of the blade 61. Specifically, it is found that the blocking layer 70 becomes poor as illustrated in FIG. 5B when the toner charged with the reverse polarity (positive polarity) of the regular charge polarity is collected, and in contrast, the blocking layer 70 becomes solid as illustrated in FIG. 5A when the toner charged with the regular charge polarity (negative polarity) is collected.

As for the mechanism by which the blocking layer becomes solid, it is thought that the solidness is influenced by the electrostatic adhesion force between the photosensitive member 2 and the toner. In the embodiment, since the reversal development technique is employed, the charge polarity of the photosensitive member 2 is the negative polarity. Therefore, the electrostatic adhesion force of the toner with the positive polarity to the photosensitive member 2 is higher than the electrostatic adhesion force of the toner with the negative polarity to the photosensitive member 2. In the case of the toner with the positive polarity that is the reverse polarity of the electric potential (negative polarity) of the surface of the photosensitive member 2, the adhesion force of the toner to the photosensitive member 2 is strong. Therefore, when the toner with the positive polarity comes to the blade 61, the toner with the positive polarity is unlikely to be stripped from the photosensitive member 2. Further, it is thought that the toner with the positive polarity adhering to the photosensitive member 2 disarranges the blocking layer 70 by continuing to press the blocking layer 70 at a strong force in the rotation direction of the photosensitive member 2 or the toner with the positive polarity penetrates the tip of the blade 61 to form a through-hole. Then, it is thought that the external additive forming the blocking layer 70 slips from the through-hole so that the blocking layer 70 becomes poor.

On the other hand, the adhesion force of the toner with the negative polarity to the photosensitive member 2 is weak. Therefore, when the toner with the negative polarity comes to the blade 61, the toner is likely to be stripped from the photosensitive member 2 by the blade 61, and is unlikely to have an influence such as the disarrangement of the blocking layer 70. After stripped from the photosensitive member 2, the toner with the negative polarity, which has a weak adhesion force to the photosensitive member 2, is rotated so as to be retained at the tip of the blade 61. Thereby, it is thought that the external additive as a constituent element of the blocking layer 70 is easily isolated from the toner so that the blocking layer 70 becomes more solid.

Hence, the embodiment controls the condition of the blocking layer 70 at the tip of the blade 61, by controlling the charge polarity of the toner that is fed to the blade 61, and suppresses the increase in the amount of the toner and external additive that slip through the blade 61 in a particular station 1. That is, the toner with the negative polarity is initiatively fed to the station 1 that collects a large amount of the toner with the positive polarity and in which the blocking layer 70 is likely to become poor. Thereby, the blocking layer 70 is made to be solid, and the condition of the blocking layer 70 is stably maintained. Specifically, as described above, the toner discharged in the discharged process and charged with the negative polarity is initiatively fed to the station 1 that collects a large amount of the toner charged with the positive polarity by the conductive brush 31 and the charge roller 32.

That is, in the embodiment, the residual toner is charged with the reverse polarity of the regular charge polarity by the conductive brush 31 and the charge roller 32 in the image forming apparatus 10. Then, the residual toner is transferred to at least one photosensitive member 2, and is removed from the photosensitive member 2 by the blade 61. Further, the image forming apparatus 10 includes the control unit 11. The control unit 11 executes the supply operation to supply the toner charged with the regular charge polarity, to the abutting portion between the at least one photosensitive member 2 and the blade 61, at the time of the image non-formation. In the execution of the supply operation, the control unit 11 performs the following control. That is, the control unit 11 estimates the photosensitive member 2 in which the greatest amount of the residual toner charged with the reverse polarity of the regular charge polarity reaches the above abutting portion after the last supply operation is executed and before the current supply operation is executed. Then, based on the estimated photosensitive member 2, the control unit 11 supplies the greatest amount of the toner charged with the regular charge polarity, in the current supply operation.

6. Image Output Experiment Result

Next, the result of an image output experiment in the control by the embodiment and a control by a comparison embodiment will be described. The control by the comparison embodiment is different from the control by the embodiment in the station 1 that collects the discharged toner with the negative polarity, as follows. In the case of a five-sheet intermittent print, the positive bias is applied to the primary transfer roller 5*a* of the first station 1*a* and the negative bias is applied to the primary transfer roller 5*b* of the second station 1*b*, in the period C in FIG. 4A. Thereby, the discharged toner with the negative polarity is collected in the second station 1*b*. In the case of a two-sheet intermittent print, the negative bias is applied to the primary transfer roller 5*a* of the first station 1*a* and the positive bias is applied to the primary transfer roller 5*b* of the second station 1*b*, in the period C in FIG. 4B. Thereby, the discharged toner with the negative polarity is collected in the first station 1*b*.

The image output experiment (paper pass duration test) was performed as follows. As the recording material P, GF-C081 (Canon Marketing Japan Inc., trade name) was used, a text image was printed. In the text image, the coverage rate (image area rate) of each color of yellow, magenta, cyan and black was 1%. As the image formation mode, a plain paper mode was used. The process speed was 180 mm/sec, and the throughput was 30 sheets per minute. As the print, the two-sheet intermittent print and the five-sheet intermittent print were executed. In the two-sheet intermittent print, a two-sheet continuous print was performed repeatedly, and in the five-sheet intermittent print, a five-sheet continuous print was performed repeatedly. The sampling of evaluation images was performed at the start time and every time the number of prints reached 5000. As the evaluation images, three halftone images with a coverage rate of 25% were output for each color of yellow (the first station) and magenta (the second station). Whether a stripe density unevenness caused by a charge unevenness of the drum charge roller 3 appeared was evaluated for the sampled evaluation images. FIG. 7 illustrates a table of the result of the durability in the two-sheet intermittent pass. FIG. 8 illustrates a table of the result of the durability in the five-sheet intermittent pass. In the tables, PASS indicates that the stripe density unevenness did not appear, and FAIL indicates that the stripe density unevenness appeared.

As illustrated in FIG. 7, in the case of the two-sheet intermittent print, in the comparison embodiment, the stripe density unevenness appeared on the magenta halftone image of the evaluation images sampled at the time of 15000 sheets. By the observation of the drum charge roller 3*b* of the second station 1*b*, it was confirmed that the drum charge roller 3*b* was dirtied by the external additive, corresponding to the spot where the stripe density unevenness appeared. Thereafter, by the continuation of the image output experiment, the drum charge roller 3*b* was further dirtied, and a clearer stripe density unevenness continued to appear on the evaluation images.

On the other hand, in the embodiment, even in the evaluation images sampled at the time of 25000 sheets, the image defect did not appear on the magenta halftone image. Although the drum charge roller 3*b* of the second station 1*b* was observed, the adhesion amount of the external additive was significantly smaller compared to the comparison embodiment. The reason is considered that the blocking layer 70 could be stably formed at the tip of the blade 61*b* because the discharged toner with the negative polarity was collected in the second station 1*b* that collected the residual toner charged with the positive polarity, unlike the comparison embodiment.

As illustrated in FIG. 8, in the case of the five-sheet intermittent print, in the comparison embodiment, the stripe density unevenness appeared on the yellow halftone image of the evaluation images sampled at the time of 25000 sheets. By the observation of the drum charge roller 3*a* of the first station 1*a*, it was confirmed that the drum charge roller 3*a* was dirtied by the external additive, corresponding to the spot where the stripe density unevenness appeared.

On the other hand, in the embodiment, even in the evaluation images sampled at the time of 40000 sheets, the image defect did not appear on the yellow halftone image. Although the drum charge roller 3*a* of the first station 1*a* was observed, the adhesion amount of the external additive was significantly smaller compared to the comparison embodiment. The reason is considered that the blocking layer 70 could be stably formed at the tip of the blade 61*a* because the discharged toner with the negative polarity was collected in the first station 1*a* that collected the residual toner charged with the positive polarity, unlike the comparison embodiment.

Incidentally, in the five-sheet intermittent print, the number of the activation and deactivation operations of the apparatus is smaller compared to the two-sheet intermittent print. Therefore, the drive time of the photosensitive member 2 is shorter with respect to a predetermined number of prints, and the life of the drum charge roller 3 is longer.

As described above, in the embodiment, the discharged toner with the negative polarity is initiatively fed to the station 1 that collects the greatest amount of the toner with the positive polarity and in which the blocking layer 70 is likely to become poor. Thereby, the condition of the blocking layer 70 is stably maintained. Since the condition of the blocking layer 70 is stably maintained, it is possible to suppress the friction between the blade 61 and the photosensitive member 2, and to suppress a crack or flaw of the tip of the blade 61, or a tear or stick-slip (chatter) of the blade. Therefore, it is hard for the toner and the external additive to slip through the blade 61, and as a result, it is possible to inhibit the drum charge roller 3 from being dirtied by the toner and the external additive. That is, in the embodiment, it is possible to maintain a good cleaning performance of the blade 61 for a long time, to inhibit the drum charge roller 3 from being dirtied by the toner and the external additive, and to prolong the life of the image forming unit 1 (the drum charge roller 3).

In the embodiment, the number of prints in the job is used as the image formation information. The station that collects the discharged toner with the negative polarity may be changed, depending on not only the number of prints in the job but also the coverage rate of each page, as the image formation information. For example, in the case where the first to third images have low coverage rates and the fourth and fifth images have high coverage rates when the five-sheet continuous print is performed in the job, it is expected that the residual toner amount of the fourth and fifth images is greater than the residual toner amount of the first to third images. In this case, the station 1 that collects the greatest amount of the toner with the positive polarity is the second station 1*b*, and therefore, it is desirable to collect the discharged toner with the negative polarity in the second station 1*b*. In this way, it is desirable to select the station 1 that collects the discharged toner with the negative polarity, in view of not only the number of prints in the job but also the coverage rate (coverage amount) of the image for each page. Specifically, the control unit 11 calculates the coverage amount (pixel count) from the image information data of each output image, and integrates the pixel count in the station in which the residual toner of each output image is charged with the positive polarity and is collected. Then, the control unit 11 compares the integrated values of the pixel counts in the stations, and makes the station 1 with the largest pixel-count integration value collect the discharged toner with the negative polarity. That is, the control unit 11 can evaluate the photosensitive member 2 in which the greatest amount of the residual toner is transferred in the job, based on the information about the amount of the residual toner corresponding to each image to be formed in the job and the information of to what photosensitive member 2 the residual toner corresponding to each image is transferred.

In the embodiment, the residual toners of the images for the "last sheet" and "next-to-last sheet" in the job are collected in the second station 1*b*. However, for example, for shortening the time of the post rotation in print, the residual toners of the images for the "last sheet" and "next-to-last sheet" may be also collected in the first station 1*a*. In that case, the station that collects the greatest amount of the toner with the positive polarity is the first station 1*a*, regardless of the number of prints in the job. Therefore, it is desirable to collect all the discharged toner with the negative polarity in the first station 1*a*. In this case, the amount of the toner that is collected in the first station 1*a* is greater than in the other stations 1*b* to 1*d*. Therefore, for example, it is desirable to increase the capacity of the collected toner container 62 of the first station 1*a*, or to provide a mechanism that conveys the collected toner to a waste toner collection container. The waste toner collection container is separately provided, and can be detached independently of the apparatus body of the image forming apparatus 10.

[Embodiment 2]

Next, another embodiment of the present invention will be described. The basic construction and operation of an image forming apparatus in the embodiment are the same as those in Embodiment 1. Therefore, for elements having identical or corresponding functions or construction to those in Embodiment 1, the description in Embodiment 1 is applied, and the repetitive detailed description is omitted (the same goes for Embodiment 3 described later).

In the control in Embodiment 1, when many continuous prints are performed in the job, the toner with the positive polarity continues to be fed to the photosensitive member 2*a* of the first station 1*a*, so that the blocking layer 70 at the tip of the blade 61*a* of the first station 1*a* becomes poor gradually.

Hence, in the embodiment, the discharged process (the discharged process in sheet intervals) is performed in the sheet interval every predetermined print number, and the discharged toner with the negative polarity is periodically fed to the poor blocking layer 70 at the tip of the blade 61*a* of the first station 1*a*. Thereby, even when many continuous prints are performed, the blocking layer 70 is stably maintained.

Specifically, the negative bias is applied to the conductive brush 31 and the charge roller 32, at the timing of the sheet interval every predetermined print number, and the toner with the negative polarity is discharged from the conductive brush 31 and the charge roller 32 to the intermediate transfer belt 20. Then, the negative bias is applied to the primary transfer roller 5*a* of the first station 1*a*, at the timing when the discharged toner with the negative polarity reaches the primary transfer unit N1*a* of the first station 1*a*. Thereby, the discharged toner with the negative polarity is transferred to the photosensitive member 2*a* of the first station 1*a*, and the toner with the negative polarity is fed to the blade 61*a* of the first station 1*a*. The frequency of the discharged process in sheet intervals is selected such that the cleaning performance of the blade 61 is sufficiently maintained even when many continuous prints are performed, and in the embodiment, the discharged process in sheet intervals is performed every 30 sheets. In the embodiment, in the discharged process in sheet intervals, the negative bias is applied just once, for reducing the downtime as much as possible.

Figure 6:
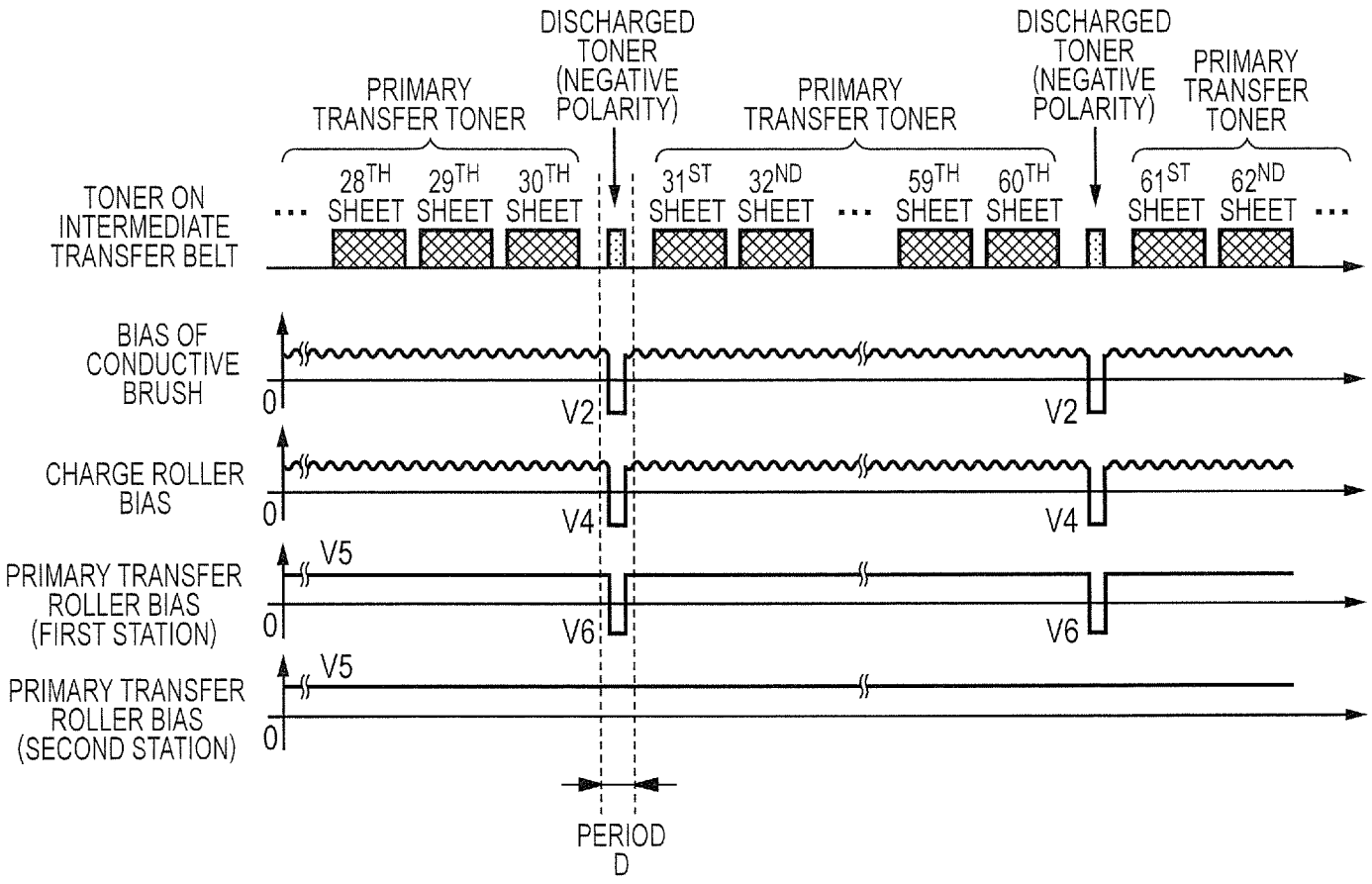
FIG. 6 is a timing chart for a control in another embodiment.

The detail of the discharged process in sheet intervals will be described with use of FIG. 6. FIG. 6 illustrates biases that are applied to the conductive brush 31, the charge roller 32, the primary transfer roller 5*a* of the first station 1*a* and the primary transfer roller 5*b* of the second station 1*b* when many continuous prints are performed in the job. The abscissas (time axes) in FIG. 6 are shifted, similarly to FIG. 4A and FIG. 4B.

As illustrated in FIG. 6, when regions on the intermediate transfer belt 20 where the first to 30th images are primarily transferred pass, the positive biases (target current values of 20 μA and 30 μA respectively) are applied to the conductive brush 31 and the charge roller 32 under constant current control, respectively. When the above regions pass through the first station 1*a*, the positive bias V5 (=+600 V) is applied to the primary transfer roller 5*a* of the first station 1*a* under constant voltage control. Thereby, in the first station 1*a*, the residual toners charged with the positive polarity by the conductive brush 31 and the charge roller 32 are transferred to the photosensitive member 2*a*, simultaneously with the primary transfer. In the embodiment, even at the time of sheet interval, the photosensitive member 2 is evenly charged at the same charge potential as that at the time of image formation.

Next, in the embodiment, the sheet interval (a period D in FIG. 6) between the 30th sheet and the 31st sheet is extended. The negative bias V2 (=−1000 V) and the negative bias V4 (=−1500 V) are applied to the conductive brush 31 and the charge roller 32 respectively, such that the toner with the negative polarity is discharged to the sheet interval position (the discharged process in sheet intervals). The negative bias V6 (=−1000 V) is applied to the primary transfer roller 5*a* of the first station 1*a*, at the timing when the discharged toner with the negative polarity reaches the primary transfer unit N1*a* of the first station 1*a*. Thereby, the discharged toner with the negative polarity is transferred to the photosensitive member 2*a* of the first station 1*a*. Incidentally, on the spot where the toner with the negative polarity is discharged, the residual toner is also present and the toner with the positive polarity is mixed in minute amounts. The toner with the positive polarity present in minute amounts is not collected in the first station 1*a* and is collected in the second station 1*b*, because the positive bias V5 (=600 V) is applied to the primary transfer roller 5*b* when the toner reaches the primary transfer unit N1*b* of the second station 1*b*.

After the discharged process in sheet intervals, the positive bias V5 (=600 V) is applied to the primary transfer roller 5*a* of the first station 1*a* again, and the residual toner charged with the positive polarity is collected simultaneously with the primary transfer of the 31st image and subsequent images. Thereafter, in the case where the print is continued, the discharged process in sheet intervals is performed also in the sheet interval between the 60th sheet and the 61st sheet, in the above way. In the case where the print is further continued, the discharged process in sheet intervals is repeatedly performed in the sheet interval every 30 sheets, in the above way. Thus, in the embodiment, the discharged process in sheet intervals and the collection process for the toner discharged in the discharged process in sheet intervals configure a supply operation to supply the toner charged with the regular charge polarity to the abutting portion between the photosensitive member 2 and the blade 61.

Next, the result of an image output experiment in the control by the embodiment and a control by a comparison embodiment will be described. The control by the comparison embodiment is different from the control by the embodiment, in that the discharge process in sheet intervals is not performed.

The image output experiment (paper pass duration test) was performed in the same procedure as the experiment by which the results in FIG. 7 and FIG. 8 were obtained. However, in this experiment, the print was a continuous print. In the embodiment, the discharged process in sheet intervals was performed every 30 sheets, but in the comparison embodiment, the discharged process in sheet intervals was not performed. The sampling of evaluation images was performed at the start time and every time the number of prints reached 10000. As the evaluation images, three halftone images with a coverage rate of 25% were output in yellow (the first station). Then, similarly to the table in FIG. 7 and the table in FIG. 8, FIG. 9 illustrates a table of the result of the evaluation of whether the stripe density unevenness appeared in the case of the continuous paper pass. In the table, PASS indicates that the stripe density unevenness did not appear, and FAIL indicates that the stripe density unevenness appeared.

As illustrated in FIG. 9, in the comparison embodiment, the stripe density unevenness appeared on the yellow halftone image of the evaluation images sampled at the time of 40000 sheets. By the observation of the drum charge roller 3*a* of the first station 1*a*, it was confirmed that the drum charge roller 3*a* was dirtied by the external additive, corresponding to the spot where the stripe density unevenness appeared.

On the other hand, in the embodiment, even in the evaluation images sampled at the time of 70000 sheets, the image defect did not appear on the yellow halftone image.

Although the drum charge roller 3*a* of the first station 1*a* was observed, the adhesion amount of the external additive was significantly smaller compared to the comparison embodiment. The reason is considered that the blocking layer 70 could be stably formed at the tip of the blade 61*a* because the toner with the negative polarity was periodically fed to the blade 61*a* of the first station 1*a* in many continuous prints, unlike the comparison embodiment.

Incidentally, in the continuous print, the number of the activation and deactivation operations of the apparatus is smaller compared to the intermittent print. Therefore, the drive time of the photosensitive member 2 is shorter with respect to a predetermined number of prints, and the life of the drum charge roller 3 is longer.

As described above, in the embodiment, even when many continuous prints are performed in the job, the toner with the negative polarity is periodically fed to the blade 61*a* of the first station 1*a* to which the toner with the positive polarity continues to be fed. Thereby, it is possible to stably form the blocking layer 70 at the tip of the blade 61*a*, to maintain a good cleaning performance, and to inhibit the drum charge roller 3 from being dirtied by the toner and the external additive.

In the embodiment, the discharged process in sheet intervals is performed every 30 sheets, but the frequency of the discharged process in sheet intervals is not limited to this. The frequency may be higher, or may be lower. As the frequency of the discharge of the toner with the negative polarity in the continuous print increases, the condition of the blocking layer 70 can be maintained at a solider condition. However, if the discharged process is performed at a high frequency in the continuous print in the case where the sheet interval needs to be extended for performing the discharged process, there is a concern that the downtime (the time period during which the image cannot be output) increases and the print productivity decreases. Therefore, it is desirable to select an optimal frequency of the sheet-interval discharge in view of the balance between the life of the drum charge roller 3 and the print productivity.

[Embodiment 3]

Next, yet another embodiment of the present invention will be described. The amount of the toner to accumulate on the conductive brush 31 at the time of the cleaning operation depends on the amount of the toner with the negative polarity that is contained in the residual toner. Therefore, in principle, the amount of the toner to accumulate on the conductive brush 31 varies depending on the charge distribution of the residual toner. For example, in comparing the residual toner having a charge distribution as illustrated in FIG. 3B and the residual toner having a charge distribution in which the peak is shifted to the positive polarity side as shown in FIG. 3C, the amount of the toner to accumulate on the conductive brush 31 is smaller in the case of the latter. The amount of the toner to accumulate on the conductive brush 31 decreases as the charge distribution of the residual toner is shifted to the positive polarity side. The decrease in the amount of the toner to accumulate on the conductive brush 31 means the increase in the amount of the toner that is charged with the positive polarity by the conductive brush 31 and the charge roller 32 and the increase in the amount of the toner with the positive polarity that is transferred to the photosensitive member 2 and is fed to the blade 61.

That is, as the charge distribution of the residual toner is shifted to the positive polarity side, the toner with the positive polarity that is fed to the blade 61 increases, and in contrast, the amount of the toner with the negative polarity that is fed to the blade 61 in the discharged process decreases. As a result, as the charge distribution of the residual toner is shifted to the positive polarity side, the blocking layer 70 tends to become poorer, and the cleaning performance of the blade 61 is prone to decrease.

Hence, in the embodiment, on a predetermined condition, in addition to the discharged toner with the negative polarity, the toner with the negative polarity is discharged also from the developing apparatus 4, and the amount of the toner with the negative polarity that is fed to the blade 61 is increased. The predetermined condition is the condition that the charge distribution of the residual toner is shifted to the positive polarity side to such a degree that the toner with the negative polarity needs to be added from the developing apparatus 4. That is, in the case where the amount of the discharged toner with the negative polarity is small even though the collected amount of the toner with the positive polarity is large and therefore the blocking layer 70 is likely to become poor, the toner with the negative polarity is discharged also from the developing apparatus 4. Thereby, a sufficient amount of the toner with the negative polarity is supplied to the blade 61, and the blocking layer 70 is stably maintained.

The condition for performing the process (development discharge process) of discharging the toner with the negative polarity from the developing apparatus 4 in the embodiment will be described. In the embodiment, when a cardboard mode is selected as the image information mode, the control unit 11 performs a control to execute the development discharge process. The image formation mode is selected, for example, by inputting the instruction to the control unit 11 through an operation unit 12 provided on the image forming apparatus 10 or through an operation unit (not illustrated) of an external apparatus such as a personal computer connected so as to be communicable with the image forming apparatus 10. In the embodiment, the image forming apparatus 10 can execute the image formation in a plurality of image formation modes, that is, in the plain paper mode and in the cardboard mode. The cardboard mode is an image formation mode to be selected in the case of performing the print using a recording material (cardboard) P having a larger basis weight than the basis weight of a recording material (plain paper) P that is used for print in the plain paper mode. In the recording material P whose basis weight is relatively heavy, the electric resistance is relatively high. Therefore, when the same secondary transfer bias as that in the plain paper mode is applied in the cardboard mode, the electric field to be formed from the recording material P to the intermediate transfer belt 20 is weak, and the transfer efficiency of the toner image is low. Therefore, in the cardboard mode, the secondary transfer bias (absolute value) is set to a higher value, compared to the plain paper mode. However, since the secondary transfer bias is set to a higher value, the electric discharge to charge the toner with the positive polarity is easily generated for the toner on the intermediate transfer belt 20, and the charge distribution of the residual toner is shifted to the positive polarity side, compared to the plain paper mode. Hence, in the embodiment, when the cardboard mode is selected as the image formation mode, the development discharge process is performed such that the toner with the negative polarity is fed to the blade 61, also from the developing apparatus 4.

Next, the operation of the development discharge process will be described. The development discharge process is performed at the timing when the toner with the negative polarity discharged from the conductive brush 31 and the charge roller 32 is collected in the primary transfer unit N1. That is, the photosensitive member 2 is evenly charged, and is exposed by the exposing apparatus 7, so that a predetermined electrostatic latent image (a solid image (an image having the maximum density level) in the embodiment) is formed on the photosensitive member 2. Then, the electrostatic latent image is developed by the developing apparatus 4 using the toner with the regular charge polarity (negative polarity), such that a predetermined amount of the toner with the negative polarity is discharged onto the photosensitive member 2. When the toner discharged from the conductive brush 31 and the charge roller 32 is transferred to the photosensitive member 2 in the primary transfer unit N1, the sequence of operations is performed at the timing when the toner discharged from the developing apparatus 4 passes through the primary transfer unit N1. The negative bias is applied to the primary transfer roller 5. Therefore, even when the toner with the negative polarity discharged from the developing apparatus 4 reaches the primary transfer unit N1, the toner is not transferred to the intermediate transfer belt 20, and most of the toner is kept on the photosensitive member 2 and is fed to the blade 61. Thus, in the embodiment, the discharged process, the discharged toner collection process and the development discharge process configure a supply operation to supply the toner charged with the regular charge polarity to the abutting portion between the photosensitive member 2 and the blade 61.

In the embodiment, the amount of the toner (herein, referred to as the "development discharged toner" also) to be discharged from the developing apparatus 4 in the development discharge process is determined by the length of the solid image in the rotation direction of the photosensitive member 2. As the amount of the development discharged toner increases, the blocking layer 70 becomes solider. However, when the development discharged toner increases, the consumption amount of the toner increases. Therefore, it is desirable to select an optimal amount of the development discharged toner in view of the balance between the life of the drum charge roller 3 and the toner consumption amount. In the embodiment, in the development discharge process, the solid image, which extends over the whole of an image formation region (a region where the toner image can be formed) in the rotation axis direction of the photosensitive member 2, is formed in a range of 1.0 mm in the rotation direction of the photosensitive member 2.

Next, the result of an image output experiment in the control by the embodiment and a control by a comparison embodiment will be described. The control by the comparison embodiment is different from the control by the embodiment, in that the development discharge process is not performed.

The image output experiment (paper pass duration test) was performed as follows. As the recording material P, GF-C104 (Canon Marketing Japan Inc., trade name) was used, and an image with a coverage rate of 25% for each of yellow, magenta, cyan and black was printed. As the image formation mode, the cardboard mode was used. The process speed was 135 mm/sec, and the throughput was 22 sheets per minute. As the print, a ten-sheet intermittent print was executed. In the ten-sheet intermittent print, a ten-sheet continuous print was performed repeatedly. The sampling of evaluation images was performed at the start time and every time the number of prints reached 5000. As the evaluation images, three halftone images with a coverage rate of 25% were output in yellow (the first station). In FIG. 10, whether the stripe density unevenness appeared was evaluated, similarly to the experiment providing the results in FIG. 7 and FIG. 8. The result is illustrated in the table of FIG. 10. Similarly to the table in FIG. 7 and the table in FIG. 8, FIG. 10 illustrates a table of the result of the durability in the ten-sheet intermittent pass paper in the cardboard mode. In the table, PASS indicates that the stripe density unevenness did not appear, and FAIL indicates that the stripe density unevenness appeared.

As illustrated in FIG. 10, in the comparison embodiment, the stripe density unevenness appeared on the yellow halftone image of the evaluation images sampled at the time of 40000 sheets. By the observation of the drum charge roller 3*a* of the first station 1*a*, it was confirmed that the drum charge roller 3*a* was dirtied by the external additive, corresponding to the spot where the stripe density unevenness appeared.

On the other hand, in the embodiment, even in the evaluation images sampled at the time of 55000 sheets, the image defect did not appear on the yellow halftone image. Although the drum charge roller 3*a* of the first station 1*a* was observed, the adhesion amount of the external additive was significantly smaller compared to the comparison embodiment. The reason is considered that the blocking layer could be stably formed by feeding the toner with the negative polarity discharged from the developing apparatus 4*a* to the blade 61*a*, in addition to the toner with the negative polarity discharged from the conductive brush 31 and the charge roller 32, unlike the comparison embodiment.

As described above, in the embodiment, in the cardboard mode in which the charge distribution of the residual toner is easily shifted to the positive polarity side, the toner with the negative polarity discharged from the developing apparatus 4 is fed to the blade 61, in addition to the toner with the negative polarity discharged from the conductive brush 31 and the charge roller 32. Thereby, it is possible to stably form the blocking layer 70 at the tip of the blade 61, to maintain a good cleaning performance, and to inhibit the drum charge roller 3 from being dirtied by the toner and the external additive.

In the embodiment, the condition for performing the development discharge process is the selection of the cardboard mode as the image formation mode, but is not limited to this. On the condition that a sufficient amount of the toner with the negative polarity is not fed from the conductive brush 31 and the charge roller 32 even though the collected amount of the toner with the positive polarity on the photosensitive member 2 is large, it is desirable to perform the development discharge process so as to complement the amount of the toner with the negative polarity that is fed to the blade 61.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-073054, filed Mar. 31, 2016, which is hereby incorporated by reference herein in its entirety.

What is claimed is:

1. An image forming apparatus comprising:

a plurality of image bearing members configured to bear toner images;

a plurality of cleaning members configured to abut on the plurality of image bearing members respectively to remove toner from the image bearing members;

a movable intermediate transferring member configured to convey the toner images primarily transferred from the plurality of image bearing members for secondarily transferring the toner images to a recording material;

a charging member configured to charge residual toner with a reverse polarity of a regular charge polarity, the residual toner being toner remaining on the intermediate transferring member after the secondary transfer; and a control unit configured to execute a supply operation to supply toner charged with the regular charge polarity to at least one abutting portion of a plurality of abutting portions at the time of image non-formation, the plurality of abutting portions being formed by the plurality of cleaning members and the plurality of image bearing members, wherein in the supply operation, based on information of an image formation executed before the supply operation is executed, the control unit performs a control to supply an amount of the toner charged with the regular charge polarity to a predetermined image bearing member among the plurality of image bearing members, so that the amount of the toner charger with the regular charge polarity supplied to the predetermined image bearing member is the greatest among the amounts of the toner charged with the regular charge polarity suppled to each of the plurality of image bearing members, and wherein an amount of the residual toner charged with the reverse polarity on the predetermined image bearing member is the greatest among the amounts of the residual toner charged with the reverse polarity on each of the plurality of image bearing members.

2. An image forming apparatus according to claim 1, wherein in the supply operation, the control unit supplies the toner charged with the regular charge polarity from the charging member to the intermediate transferring member.

3. An image forming apparatus according to claim 1, further comprising a plurality of developing devices that is provided so as to correspond to the plurality of image bearing members, respectively, and that supplies toner to electrostatic latent images formed on the image bearing members, wherein in the supply operation, the control unit supplies the toner charged with the regular charge polarity from one of the plurality of developing devices to a corresponding image bearing member.

4. An image forming apparatus according to claim 1, wherein the control unit uses the number of prints in a job as image formation information.

5. An image forming apparatus according to claim 4, wherein in a job in which images are formed and output on a single or a plurality of recording materials, the control unit determines that the predetermined image bearing member is an image bearing member on the most upstream side in a moving direction of the intermediate transferring member, when the number of the images to be formed is greater than or equal to a predetermined value, and determines that the predetermined image bearing member is an image bearing member on a downstream side of the image bearing member on the most upstream side, when the number of the images to be formed is less than the predetermined value.

6. An image forming apparatus according to claim 1, wherein the control unit executes the supply operation in a post rotation process as the time of the image non-formation, the post rotation process being a process after completion of formation of all images in a job in which the images are formed and output on a single or a plurality of recording materials.

7. An image forming apparatus according to claim 1, wherein the control unit executes the supply operation in an image interval process as the time of the image non-formation, the image interval process being a process in a job in which images are formed and output on a plurality of recording materials.

8. An image forming apparatus according to claim 1, wherein each of the plurality of cleaning members is a blade-shaped member.

9. An image forming apparatus according to claim 1, wherein the charging member is a charge brush that rubs on the intermediate transferring member.

* * * * *